US008526649B2

(12) United States Patent
Foo et al.

(10) Patent No.: US 8,526,649 B2
(45) Date of Patent: Sep. 3, 2013

(54) PROVIDING NOTIFICATION SOUNDS IN A CUSTOMIZABLE MANNER

(75) Inventors: Edwin W. Foo, San Mateo, CA (US); Gregory F. Hughes, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 293 days.

(21) Appl. No.: 13/029,849

(22) Filed: Feb. 17, 2011

(65) Prior Publication Data

US 2012/0213393 A1 Aug. 23, 2012

(51) Int. Cl.
*H04R 25/00* (2006.01)

(52) U.S. Cl.
USPC ..... 381/315; 381/312

(58) Field of Classification Search
USPC ..... 381/312, 315
See application file for complete search history.

(56) References Cited

U.S. PATENT DOCUMENTS

| | | | | |
|---|---|---|---|---|
| 7,062,223 | B2 | 6/2006 | Gerber et al. | |
| 7,778,432 | B2 | 8/2010 | Larsen | |
| 2009/0074214 | A1 * | 3/2009 | Bradford et al. | 381/312 |
| 2010/0054512 | A1 | 3/2010 | Solum | |
| 2010/0067723 | A1 | 3/2010 | Bergmann et al. | |

* cited by examiner

*Primary Examiner* — Brian Ensey
(74) *Attorney, Agent, or Firm* — Morgan, Lewis & Bockius LLP

(57) ABSTRACT

Broadly speaking, the embodiments disclosed herein describe an apparatus, system, and method that allow a user to perceive notifications (audible or otherwise) corresponding to an external event in any manner deemed appropriate.

16 Claims, 8 Drawing Sheets

PROVIDING NOTIFICATION SOUNDS IN A CUSTOMIZABLE MANNER

FIELD OF THE DESCRIBED EMBODIMENTS

The described embodiments relate to methods and apparatus for processing and/or enhancing audio signals used by a hearing aid. In particular, a hearing assistance device, such as a hearing aid, can notify an individual having impaired hearing of an external event in a manner of their choosing.

DESCRIPTION OF THE RELATED ART

A modern hearing aid can help to mitigate at least some of the problems associated with impaired hearing by amplifying ambient sound. A modern hearing aid can receive an input audio signal using an input converter. The audio input signal can in turn be converted into electrical input signals that are routed to a signal processing unit for further processing and amplification. The further processing and amplification can be used to compensate for the individual loss of hearing of a hearing aid wearer. The signal processing unit provides an electrical output signal which is fed via an output converter to the wearer of the hearing aid so the wearer perceives the output signal as an acoustic signal. Earpieces which generate an acoustic output signal are usually used as output converters.

Electronic circuitry used by hearing aids varies among devices, even if they are the same style. The circuitry falls into three categories based on the type of audio processing (Analog or Digital) and the type of control circuitry (Adjustable or Programmable). In one category, the audio circuit is analog having electronic components that can be adjusted. With these types of hearing aids, a hearing professional (such as an audiologist or certified technician) determines the gain and other specifications required for the wearer, and then adjusts the analog components either with small controls on the hearing aid itself or by having a laboratory build the hearing aid to meet those specifications. After the adjustment is completed, the resulting audio processing does not change any further, other than possibly overall loudness that the wearer adjusts with a volume control. This type of circuitry is generally the least flexible.

In another category, the audio circuit is analog but with additional electronic control circuitry that can be programmed, sometimes with more than one program. The electronic control circuitry can be fixed during manufacturing or in some cases, the hearing professional can use an external computer temporarily connected to the hearing aid to program the additional control circuitry. The wearer can change the program for different listening environments by pressing buttons either on the device itself or on a remote control or in some cases the additional control circuitry operates automatically. This type of circuitry is generally more flexible than simple adjustable controls.

In yet another category, both the audio circuit and the additional control circuits are fully digital in nature. The hearing professional programs the hearing aid with an external computer temporarily connected to the device and can adjust all processing characteristics on an individual basis. Fully digital hearing aids can be programmed with multiple programs that can be invoked by the wearer, or that operate automatically and adaptively. These programs reduce acoustic feedback (whistling), reduce background noise, detect and automatically accommodate different listening environments (loud vs. soft, speech vs. music, quiet vs. noisy, etc.), control additional components such as multiple microphones to improve spatial hearing, transpose frequencies (shift high frequencies that a wearer may not hear to lower frequency regions where hearing may be better), and implement many other features. In some embodiments, the hearing aid wearer has almost complete control over the settings of most, but not all, settings. For example, in order to prevent unintended harm to the wearer, certain settings (such as gain) can only be changed within a well-defined range. Other settings, such a frequency response, can have more latitude but any allowed changes will nonetheless be restricted in order to prevent any changes to the audio processing that may be harmful to the hearing aid wearer.

Fully digital circuitry can also include wireless hearing aids that allow control over wireless transmission capability for both the audio and the control circuitry. Control signals in a hearing aid on one ear can be sent wirelessly to the control circuitry in the hearing aid on the opposite ear to ensure that the audio in both ears is either matched directly or that the audio contains intentional differences that mimic the differences in normal binaural hearing to preserve spatial hearing ability. Audio signals can be sent wirelessly to and from external devices through a separate module, often a small device worn like a pendant and commonly called a "streamer" that allows wireless connection to yet other external devices. In those embodiments where additional computational resources or sensor resources are required, the external devices can take the form of a portable computing device along the lines of a smart phone, tablet device, and portable media player.

Programmable hearing aids that allow a user to adjust the hearing aid response to their own preference have been recently made available at reasonable cost. Using the programmable hearing aid, for example, the frequency response of the hearing aid can be adjusted by the consumer in order to improve the overall user experience by accentuating certain frequencies or range of frequencies. In addition to programmable hearing aids, wireless hearing aids have been developed. For example, for a hearing impaired consumer using two hearing aids, an adjustment to one of the two hearing aids can be transmitted to the other hearing aid such that pressing one hearing aid's program button simultaneously changes the corresponding settings on the other hearing aid such that both hearing aids change settings simultaneously.

Therefore, with the advent of programmable hearing aids and other hearing assistance devices whose signal processing can at least be partially modified, what is desired is providing a hearing aid or hearing assistance device user the ability to modify the audio processing of the programmable hearing aid or hearing assistance device to provide information from the surrounding environment in a subtle and nuanced manner.

SUMMARY

Broadly speaking, the embodiments disclosed herein describe providing individualized notification to a hearing impaired person. More specifically, in one embodiment, a method performed by a processor for presenting an audible rendering of an event notification signal generated by a notifying device in response to an external event is described. The method is performed by carrying out at least the following operations: receiving the event notification signal at the processing device, processing the event notification signal by the processing device in accordance with a user preference to form the audible rendering of the event notification signal, passing the audible rendering of the event notification signal to an output device, and presenting the audible rendering of the event notification signal by the output device. In one embodiment, the audible rendering of the event notification signal is remapped from the audible rendering of the event notification to a remapped audible rendering based upon a remapping user preference.

A system arranged for providing hearing assistance includes at least a computing device. In one embodiment, the computing device is in communication with a hearing assistance device having an output arranged to provide an output suitable for being perceived by a user of the system and a processor that receives an event notification signal provided by a notifying device indicating that an event has occurred. The computing device processes the event notification signal in accordance with an audio processing profile to form an audible rendering of the event notification signal, passes the audible rendering of the event notification signal to the output device, and presents the audible rendering of the event notification signal by the output device.

Non-transitory computer readable medium for storing computer code executable by a processor in a hearing assistance device for presenting an audible version of an event notification signal includes at least computer code for receiving the event notification signal at a processing device, processing the event notification signal by the processing device in accordance with a user preference to form the audible rendering of the event notification signal, passing the audible rendering of the event notification signal to an output device, and presenting the audible rendering of the event notification signal by the hearing aid output device. In one embodiment, the audible rendering of the event notification signal is remapped from the audible rendering of the event notification to a remapped audible rendering in accordance with a user remapping preference.

A hearing assistance device for presenting an audible version of an event notification generated in response to at least one external event includes at least a processor, a data storage device arranged to store at least a hearing aid profile, an output device, and an interface in communication with the processor for receiving the event notification. In one embodiment, the processor processes the event notification signal to form the audible version of the event notification in accordance with the hearing aid profile, passes the audible version of the event notification signal to the output device, and presents the audible version of the event notification signal by the hearing aid output device.

Other aspects and advantages will become apparent from the following detailed description taken in conjunction with the accompanying drawings which illustrate, by way of example, the principles of the invention.

BRIEF DESCRIPTION OF THE DRAWINGS

The described embodiments will be readily understood by the following detailed description in conjunction with the accompanying drawings, wherein like reference numerals designate like structural elements, and in which.

DETAILED DESCRIPTION OF THE DESCRIBED EMBODIMENTS

Figure 1:
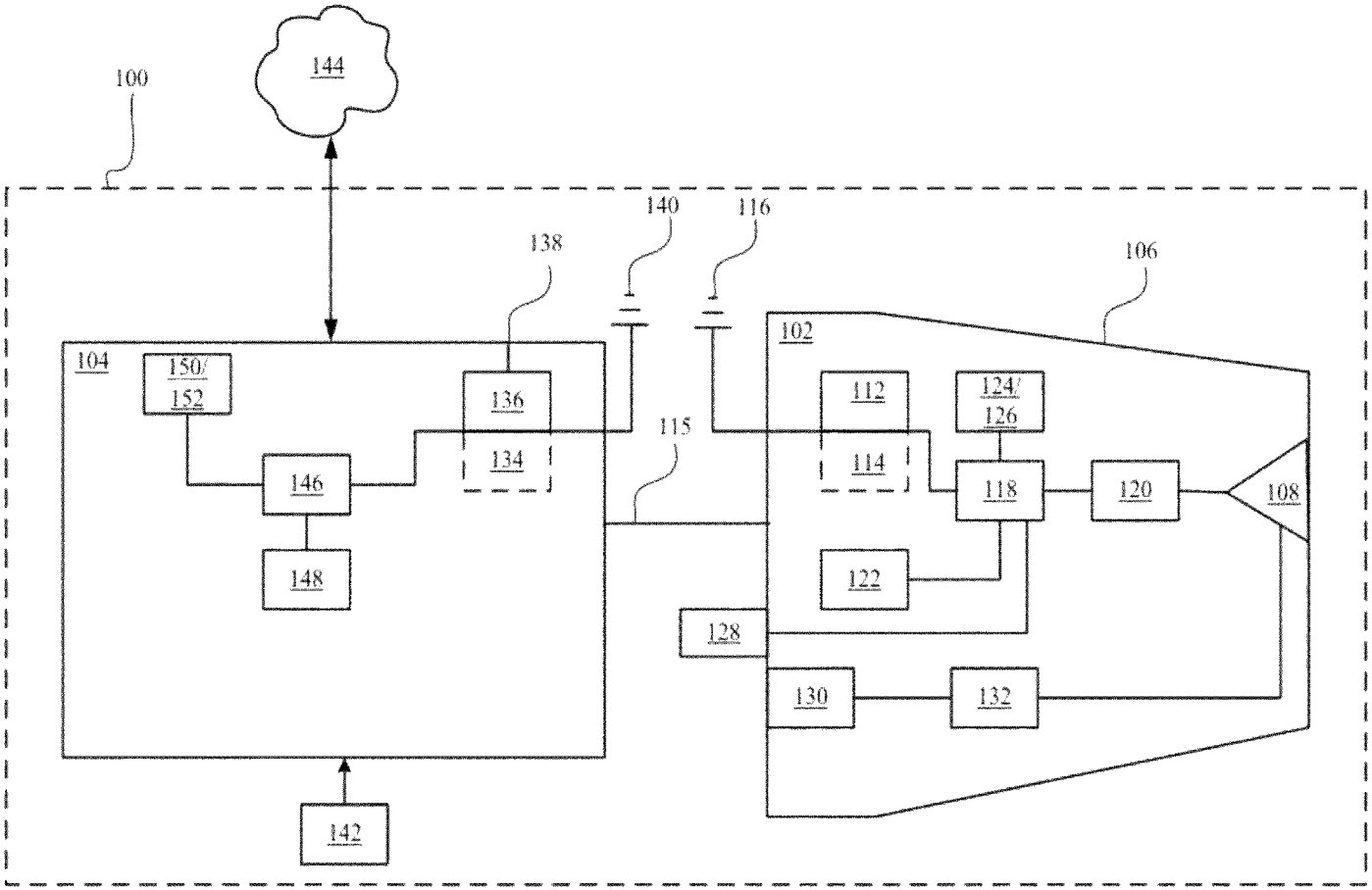
FIG. 1 depicts representative hearing assistance system 100 in accordance with the presently described embodiments.

In the following detailed description, numerous specific details are set forth to provide a thorough understanding of the concepts underlying the described embodiments. It will be apparent, however, to one skilled in the art that the described embodiments can be practiced without some or all of these specific details. In other instances, well known process steps have not been described in detail in order to avoid unnecessarily obscuring the underlying concepts.

In an attempt to compensate for specific hearing loss certain aspects of an audible environment can be augmented in such a way so as to provide additional notification of an event, or events. In some cases, an audible notification of an event associated with a device (a person ringing a doorbell or a telephone ringing) can be enhanced to compensate, at least partially, for an individual's specific hearing impairment. In one embodiment, the notifying device can be in communication with a computing device (portable or otherwise) that is in turn can be in communication with a hearing aid or other hearing assisting device, such as headphones. In one embodiment, the notifying device can be in direct communication with the hearing aid when the hearing aid includes appropriate built-in computing circuitry. The computing device can receive audible input from the device directly (such as the sound from the doorbell or phone ringer) and process the received sound to compensate for an individual's particular hearing impairment.

In one embodiment, the computing device can receive an indication not necessarily associated with an audible sound from the notifying device that an event has occurred. For example, for someone having little ability to hear any sound, it may not make sense for a smoke alarm to be associated with an audible notification event. In this situation, the smoke alarm can be audibly silent but nonetheless provide an indication that a notifying event (i.e., detection of smoke) has occurred. The indication can take many forms such as a digital data file (such as a .WAV file, MP3 file, and so forth). In one embodiment, the indication can be a code or other indicia that can be used to identify a particular event. The code can be, for example, a data string that can include information specific to the notifying device, type of event, time of event, and so forth. In this way, an event database can be created providing a history of events. In one embodiment, the indication received by the computing device from the notifying device can be used by the computing device to provide a notification of the event occurrence to an individual, or individuals. The notification can take many forms. In those situations where notifications are sent to a number of individuals, each notification can be customized for each individual, a group of individuals, and so on. In this way, the computing device can provide as many types of different notifications as there are individuals being notified.

For example, a notification sent to one individual can be vibratory in nature whereas another notification sent to another individual can be visual in nature. In one embodiment, the notification can be simply an audible rendering of a sound associated with the event. For example, the notification can take the form of a doorbell ringing or phone ringing neither of which may be audible to those having impaired hearing and must therefore be processed in such a way to enable those with impaired hearing to perceive the notification and to take action, if necessary. In some cases, the notification can take the form of a sound not usually associated with the event but nonetheless associated with the event by the individual user. For example, a chirping sound can be associated with a doorbell ring instead of the sound generated by a bell or klaxon.

However, in addition to merely replicating the sound generated by the doorbell or the phone ringer, the computing device can render the sound the sound in any manner selected by the user. In one embodiment, the rendering can take the form of modifying audio characteristics of the sound to compensate for a specific individual's hearing impairment. The modification can be based upon information associated with the individual's specific hearing impairment. The information can be associated with a hearing aid (HA) profile used to configure the audio processing carried out by the individual's hearing aid. The HA profile can be stored in the hearing aid and/or in the computing device. In any case, the audio processing can be carried out in real time. In one embodiment, the HA profile can include a set of parameters that can represent the context of the environment for which the HA profile is associated. The HA profile can be selected by the individual user to adjust the processing carried out by the audio circuitry on the audible sounds received from the external acoustic environment. In one embodiment, the HA profile can include a range of hearing aid parameters specific to the individual user. The parameters can be established by an audio technician under the guidance of a certified audiologist (or by the audiologist directly). The HA profile can then be programmed into the hearing aid and be used to adjust the processing of external audio by the audio circuitry in the hearing aid.

For example, in the case of age related high frequency loss, the computing device can emphasize lower frequencies or ranges of frequencies most likely to be heard by the individual. The notification can be associated with a particular type of stimulation that can be associated with a particular event. For example, a smoke alarm can provide an indication to a smartphone of an occurrence of a smoke event. The smartphone can receive and process the indication of the smoke event to generate a notification customized for the current possessor of the smartphone. In one embodiment, the notification can be visual in nature in that the smartphone can flash brightly on an off and/or vibrate in order to get the attention of the user. In one embodiment, the smartphone can wirelessly send a notification to an individual's hearing aid (either directly or to a processing unit in communication with the hearing aid) or hearing assisting device. In this way, the notification can be processed to generate an audible notification that can be passed by way of the hearing aid directly to the auditory system of the user.

These and other embodiments are discussed below with reference to FIGS. 1-8. However, those skilled in the art will readily appreciate that the detailed description given herein with respect to these figures is for explanatory purposes as the invention extends beyond these limited embodiments.

FIG. 1 depicts representative hearing assistance system 100 in accordance with the presently described embodiments. Hearing assistance system 100 can include aural presentation device 102 and external device 104. In a particularly useful configuration, aural presentation device 102 can take the form of hearing aid 102 and external device 104 can take the form of a computing device 104 such as a smartphone (such as an iPhone™) or portable media player (such as an iPod™) each manufactured by Apple Inc. of Cupertino, Calif. In one embodiment, hearing aid 102 can be arranged to aurally present a notification message from within an auditory canal of a user. In addition, hearing aid 102 can be arranged to provide hearing aid functionality. Hearing aid 102 can be configured for placement at least partially within the auditory canal and includes housing 106. In one embodiment, housing 106 can be configured for placement entirely within the auditory canal of the user. In accordance with this embodiment, notification messages can be presented in the auditory canal by way of output device 108 positioned within the housing, e.g., through one or more openings (represented by opening 110) in housing 106. In one embodiment, housing 106 can be configured for placement external to the auditory canal, e.g., in an exterior portion of the ear such as between the auricle of the ear and the head of the user.

Receiver 112 positioned within housing 106 can be configured to receive signals, e.g., from computing device 104. Transmitter 114 configured to transmit communication signals, e.g., to computing device 104, can be further positioned within housing 106. Receiver 112 and transmitter 114 can be independent or combined as a transceiver. Receiver 112 may be a data interface. Receiver 112 and/or transmitter 114 can communicate via a wired communication port 115 or wireless connection, e.g., using an infra-red (IR) LED or a radio frequency (RF) connection through an antenna 116. In one embodiment, computing device 104 and hearing aid 102 can be a single unit in which case wired communication port 115 (or other appropriate wired connection) can be used to pass information between computing device 104 and hearing aid 102.

Processor 118 can be coupled to receiver 112 and transmitter 114 (if present). In addition, processor 118 can be coupled to output device 108 (e.g., via an amplifier 120), memory 122, optional counter 124, and optional clock 126. Processor 118 can be configured to receive data via receiver 112, transmit data via the transmitter 114 (if present), store and retrieve data from the memory 122, and interact with the counter 124 and/or clock 126 (if present). In addition, processor 118 can be configured to process data from receiver 112, memory 122, counter 124, and/or clock 126 and is further configured to drive output device 108 (e.g., via amplifier 120) to aurally present predefined notification messages based on the processed data. Processor 118 can be further be configured to convert compressed audio signals into signals suitable for aural presentation. The audio signals can be compressed to reduce transmission bandwidth and/or to maximize use of the memory 122. An input device 128 such as a button may further be coupled to processor 118 and positioned on housing 106 to receive feedback from a user. A suitable processor for use with the present invention will be understood by one of skill in the art.

Hearing aid 102 can include components to provide hearing aid functionality. In the illustrated hearing aid 102, microphone 130 converts sound signals into electrical signals, amplifier 132 increases the amplitude of the electrical signals, and output device 108 changes the amplified electrical signal back into a form that can be used to convey audible information to the hearing air user. For example, when output device 108 is a speaker, speaker 108 can provide sound energy that is directed into the auditory canal of the user. It should be noted that output 108 can take many forms depending upon the nature of hearing aid 102. For example, in one embodiment, output 108 can take the form of an acoustic transducer arranged to provide acoustic output in the form of sound waves. The acoustic output can then be transmitted in a conventional manner to the hearing aid user's auditory system. In one embodiment, output 108 can be used to stimulate nerves in the hearing aid user's auditory system. In one embodiment, output 108 can be implanted into a bone near the hearing aid user's auditory system. In this way, electrical energy generated by output 108 can be transmitted through the bone and be used to stimulate certain auditory nerves. This type of hearing aid is generally described in terms of a cochlear implant.

Suitable microphones, amplifiers, and speakers/hearing aid receivers will be understood by one of skill in the art. The audio processing performed by the audio circuitry in a hearing aid can be based upon a number of hearing aid parameters that can be changed by adjusting controls or by programming. Such hearing aid parameters can include frequency response (e.g., signal edge displacement, rise time in the low and high tone range), gain, starting point of AGC, peak clipping, and so forth. For optimal performance, a particular audio environment can have associated with it a particular range of hearing aid parameters that can be further adjusted for the individual user. However, in order to properly adjust the audio processing of the audio circuitry, a potentially large number of hearing aid controls must be adjusted on a real time basis. Since the user can only freely adjust relatively few parameters such as volume or gain, one of the described embodiments utilizes a hearing aid parameter profile, or more simply, HA profile.

Computing device 104 can include transmitter 134 configured for transmitting signals to receiver 112 of hearing aid 102. Computing device 104 can further include receiver 136 configured for receiving signals from the transmitter 114 of hearing aid 102. Transmitter 134 and receiver 136 can be independent or combined as a transceiver. Transmitter 134 and/or the receiver 136 can communicate via wired communication port 138 or wireless connection, e.g., through antenna 140. Signals transmitted between the computing device 104 and hearing aid 102 can include data identifying the source and/or desired destination of the transmitted signals. This enables the use of one or more external devices (represented by computing device 104) with one or more aural presentation devices (represented by hearing aid 102) in the same vicinity. For example, a single external device may be used with a single aural presentation device, a single external device may be used with a plurality of aural presentation devices, a plurality of external devices may be used with a single aural presentation device, and a plurality of external devices may be used with a plurality of aural presentation devices.

In one embodiment, a string of data may be included with each transmission from a first external device to a first aural presentation device that identifies both the first external device and the first aural presentation device. When the message is received at the first aural presentation device, the first aural presentation device checks the string of data and processes the transmission if the string of data indicates that the first aural presentation device is the intended recipient. Likewise, an acknowledgement from the first aural presentation device to the first external device may include a similar string of data. When the acknowledgment is received at the first external device, the first external device checks the string of data and processes the transmission if the string of data indicates that the first external device is the intended recipient of the acknowledgment.

Computing device 104 can be configured to receive data via one or more input devices (represented by input device 142). One or more of the input devices may be incorporated into the computing device 104. The input devices may include a button, switch, keyboard, touch pad, touch screen, mouse, microphone, or essentially any device capable of generating a signal conveying information. Input device 142 can also include sensors arranged to receive both sound energy (microphone) and light energy (photometer). In this way, computing device 104 can receive information directly from the external environment in the form of sound and/or light. The input device 142 may be used to enter information and to receive feedback from a user with the aural presentation device positioned within their auditory canal. The computing device 104 may optionally be configured to receive and/or transmit communication signals via communication system 144, such as a telephone system or the Internet. Communication system 144 can enable an interested party, e.g., a relative, friend, or care provider, to initiate a notification message (sending email, calling on the phone, and so forth) and/or receive feedback from the hearing assistance system 100. For example, an interested party could contact the computing device 104 via communication system 144 using a cell phone, personal digital assistant (PDA), or essentially any communication device and remotely cause a message to be aurally presented, e.g., by entering a number corresponding to a particular predefined notification message. Additionally, the communication system may receive audio and/or text notification messages. In embodiments where text notification messages are received, the computing device 104 may include a text to speech converter (not shown) to convert the text message to an aural notification message.

Processor 146 within the computing device 104 can be coupled to transmitter 134 and to the receiver 136 (if present). Processor 146 can be further coupled to memory 148, the input device 142, optional counter 150, optional clock 152, and communication system 144. Processor 146 can be configured to transmit data via the transmitter 134, receive data via the receiver 136 (if present), receive data via the input device 142, store and retrieve data from the memory 148, and interact with the counter 150 and/or clock 152 (if present). The transmitted and received data may include the data described above for identifying particular external devices and aural presentation devices. In addition, processor 146 can be configured to process data from communication system 144, input device 142, memory 148, and counter 150 and/or clock 152 (if present), and is further configured to transmit data responsive to the processed data via transmitter 134. A suitable processor for use with the present invention will be understood by one of skill in the art.

Figure 2:
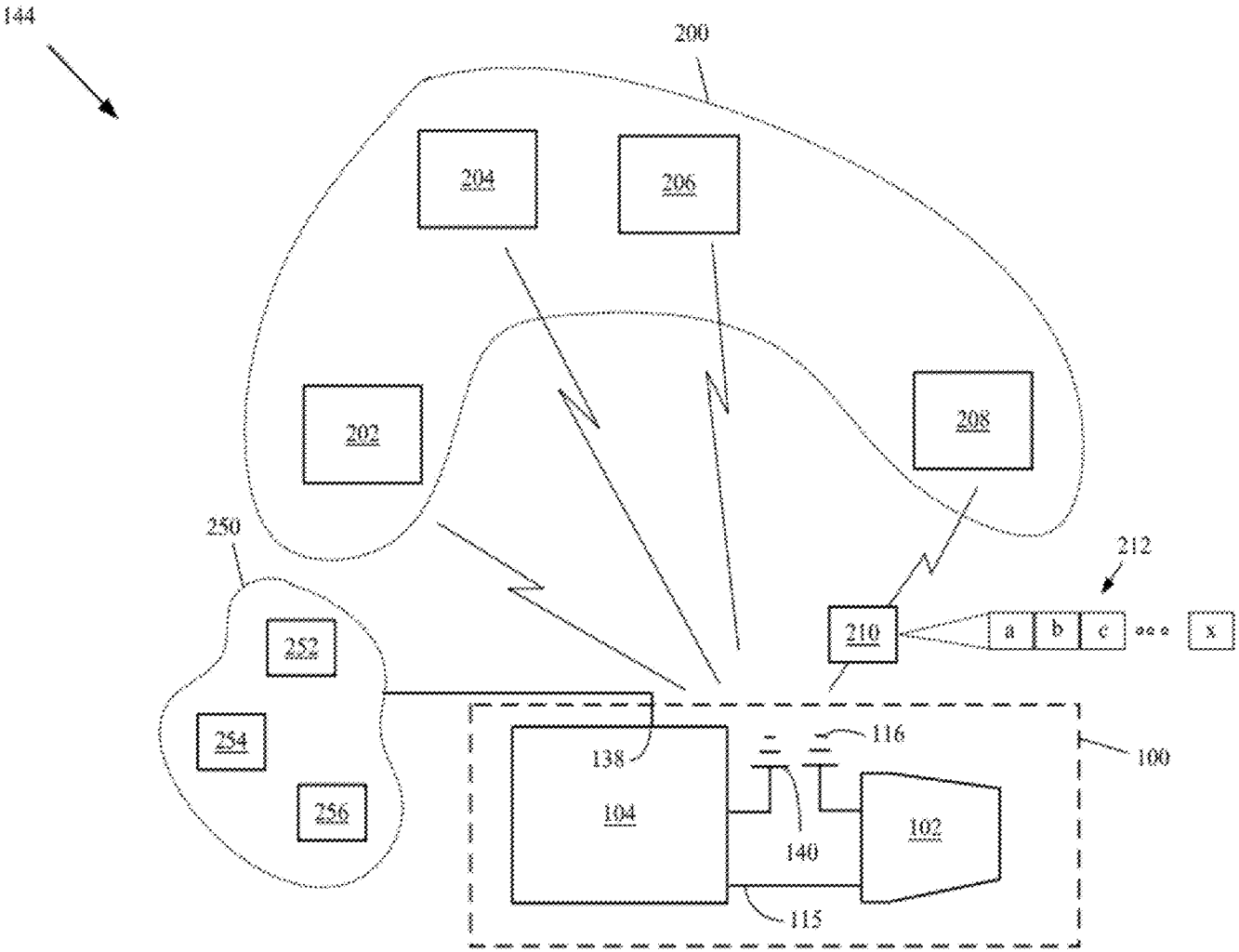
FIG. 2 illustrates a representative communication system in accordance with the described embodiments.

In one embodiment shown in FIG. 2, communication system 144 can include wireless notifying devices 200 and wired communication devices 250. Wireless notifying devices 200 can include at least doorbell 202, telephone 204, smoke alarm 206, and microphone 208. In one embodiment, each of the wireless notifying devices 200 can generate a particular audio or notification signal each of which can be received and processed by computing device 104. Wired devices 250 can include audio equipment 252, microphone 254, a conventional wired telephone (sometimes referred to as a landline) 256 and so forth. In this regard, wired input 138 can take the form of a plurality of wired inputs, namely a stereo input jack, as well as an on-board microphone array including left, center and right microphone inputs, and so on. In one embodiment, receiver 136 (as well as receiver 112) can include a T-coil sensor (not shown) for receiving signals from conventional telephones and American's with Disabilities Act (ADA) mandated T-coil loops in public buildings, or other facilities, which utilize T-coil loops to assist the hearing impaired. Accordingly, in the case of the conventional telephone have the T-coil loops, an incoming telephone call is intercepted and a signal is wirelessly sent to computing device 104 to alert the user that there is an incoming call, and if accepted, to transmit the audio signal from telephone 256 directly to computing device 104 for processing and subsequent transmission to hearing aid 102.

Receiver 136 can receive incoming wireless notification signals from wireless notifying devices 200 by way of antenna 140. Moreover, processor 146 can multiplex and de-multiplex the multiple incoming signals, distinguishing one signal from the others, as well as processing the signals separately from the other incoming signals. In one embodiment, computing device 104 can be programmed or otherwise configured to recognize each connected notifying device. In one embodiment, computing device 104 can present information identifying each of the notifying devices in communication therewith. In one embodiment, the information can be presented graphically on a display. In one embodiment, the information can be presented audibly at either computing device 104 or by hearing aid 102. In one embodiment, recognition and identification of each of wireless notifying devices 200 can be accomplished by a pairing function (similar to known Bluetooth®) where each wireless notifying device transmits identification information to computing device 104. For example, computing device 104 can recognize each notifying device and present information to the user that can be used to identify the source of the signal. In those cases where computing device 104 includes a display, a text message such as "SMOKE ALARM" or "FIRE" can be presented visually. In other contexts, an audiblized rendition corresponding to "SMOKE ALARM" or "FIRE" can be provided to hearing aid 102 for audible presentation to the user by output device 108.

Any of devices 200 and 250 can generate a notification signal that can be forwarded in real time to computing device 104. In one embodiment, the notification signal can take the form of an audible sound (such as a bell sound associated with a door bell) that can be intercepted and processed by computing device 104. In some cases, the audible sound can be processed by processor 146 in accordance with a set of user specific processing instructions. The user specific processing instructions can be based upon, for example, a hearing aid (HA) profile stored in or otherwise associated with hearing aid 102. In this situation, the audio processing of the audible notification can be in accordance with the specific hearing impairment of the user. For example, if the user has high frequency deficit based upon age or injury, then the audio processing performed by computing device 104 can enhance the audible notification such that those frequencies for which the user is more sensitive can be emphasized.

In one embodiment, the audible notification signal can be re-mapped such that the original audible notification signal can be perceived by the user as a sound that the user has chosen to represent the audible notification. For example, when doorbell 202 is activated, doorbell 202 can issue an audible notification signal having a sound corresponding to a bell, buzzer, klaxon, and so forth. The audible notification can, in turn, be received by computing device 104 at input device 142 (in the form of a microphone). Computing device 104 can process the audible notification in such a way that the user perceives not a bell ringing, a buzzer buzzing or a klaxon blaring, but rather a bird chirping, a voice intoning "someone is at the door", or a well-known show tune, and so forth.

In one embodiment, the notification signal can include information that a notification event has occurred (i.e., the doorbell is buzzing, the phone is ringing, etc.). The information can be related to the notifying device, the time of day, the processing to be performed (if any), and so forth. In one embodiment, the information can be expressed in terms of a string of characters. The string of characters can be arranged to form, for example, a data word that can be used by computing device 104 to process the information. For example, smoke alarm 206 can detect smoke and issue indication 210. Information 210 can take the form of character string 212. Character string 212 can include a number of characters some of which, taken singly or in combination, can present information that can be used by processor 146. Processor 146 can use the information to identify the source of the notification, a time of notification, a type of notification, and a re-mapping preference for providing an input (audio or otherwise) from hearing aid 102. It should be noted that the re-mapping can take many forms. For example, the re-mapping of notification signal 210 can result in the user perceiving a sound, a tactile sensation, a visual presentation, and so on each of which can be specifically selected to be associated with a particular notifying device, time of day, and so on.

Figure 3:
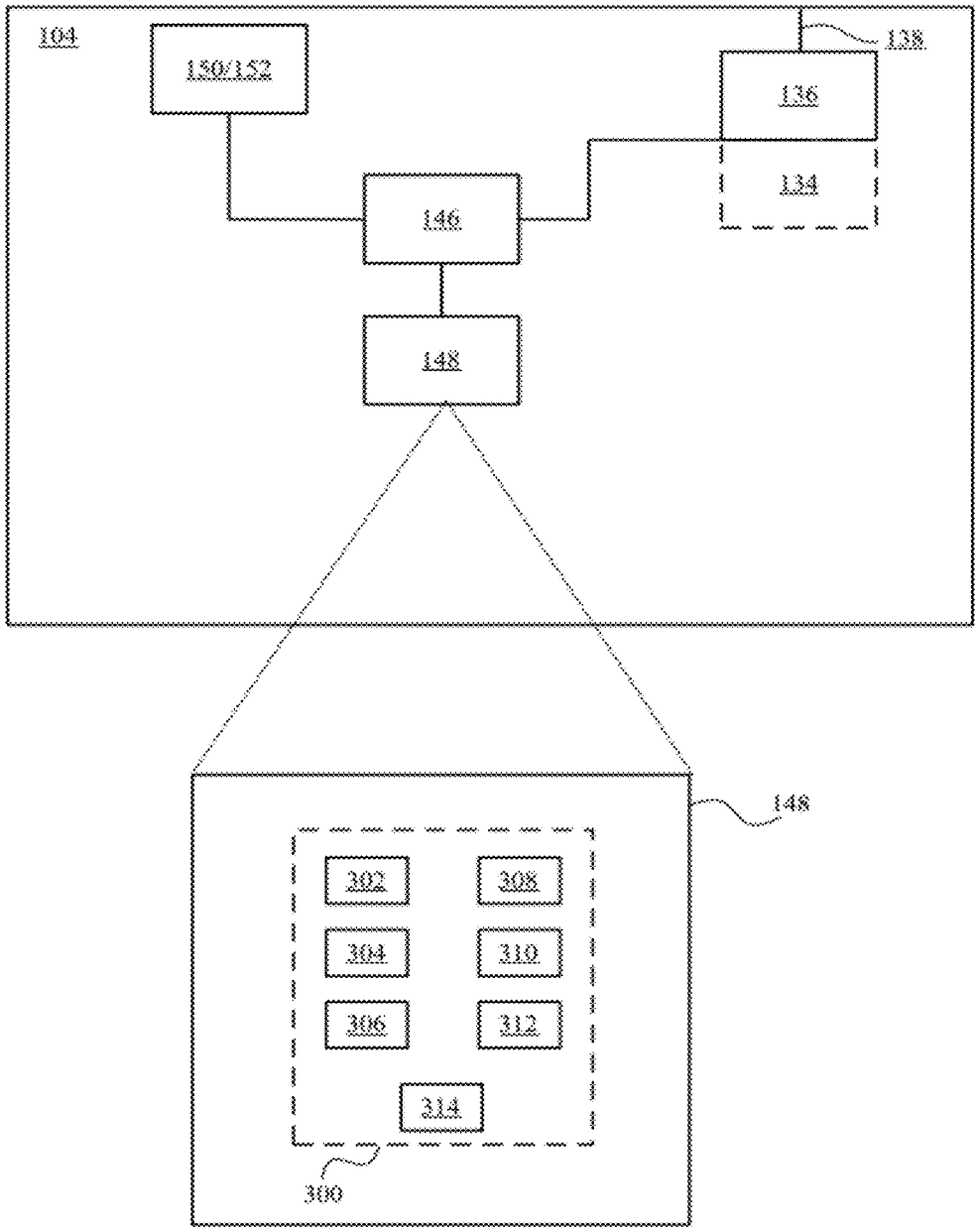
FIG. 3 shows a representative computing device having a data storage device having a plurality of enhancement modules stored therein.

In one embodiment, the user can customize processing of each incoming notification according to the particulars of the user's hearing impairment and/or hearing preferences. Accordingly, for each incoming notification, a specific enhancement process can be applied with the aim of improving the sound quality and/or perception of each of different notification sources. In one embodiment, as shown in FIG. 3, a number of enhancement modules 300 can be stored in memory 148 for selective application to an incoming notification source. For example, the user may have several different enhancement modules that have been developed for different environmental conditions, i.e. volume control 302, multi-band equalization 304, balance 306, multiple sound source mixing 308, multiple microphone beam forming 310, echo reduction 312, error correction 314, etc. In one embodiment, appropriate different enhancement modules can be applied to different incoming notifications and resulting audio streams. In one embodiment, more than one enhancement module can be selected such that the selected enhancement modules can be applied in series (i.e., one after the other).

It should be noted, however, that in some cases, the order of application of the enhancements modules may make a significant difference to the overall sound quality. The user thus has the ability to experiment with different enhancements and the order of application of enhancement modules. In one embodiment, the ordering of the application of the enhancement modules can be performed manually by the user in real time. In one embodiment, the ordering can be based upon a hearing aid (HA) profile. As a result, each individual hearing aid user can select combinations of enhancements that work well for their particular hearing deficit. The user thus has the ability to self-test and self-adjust the hearing system and customize the system for their particular needs.

Figure 4:
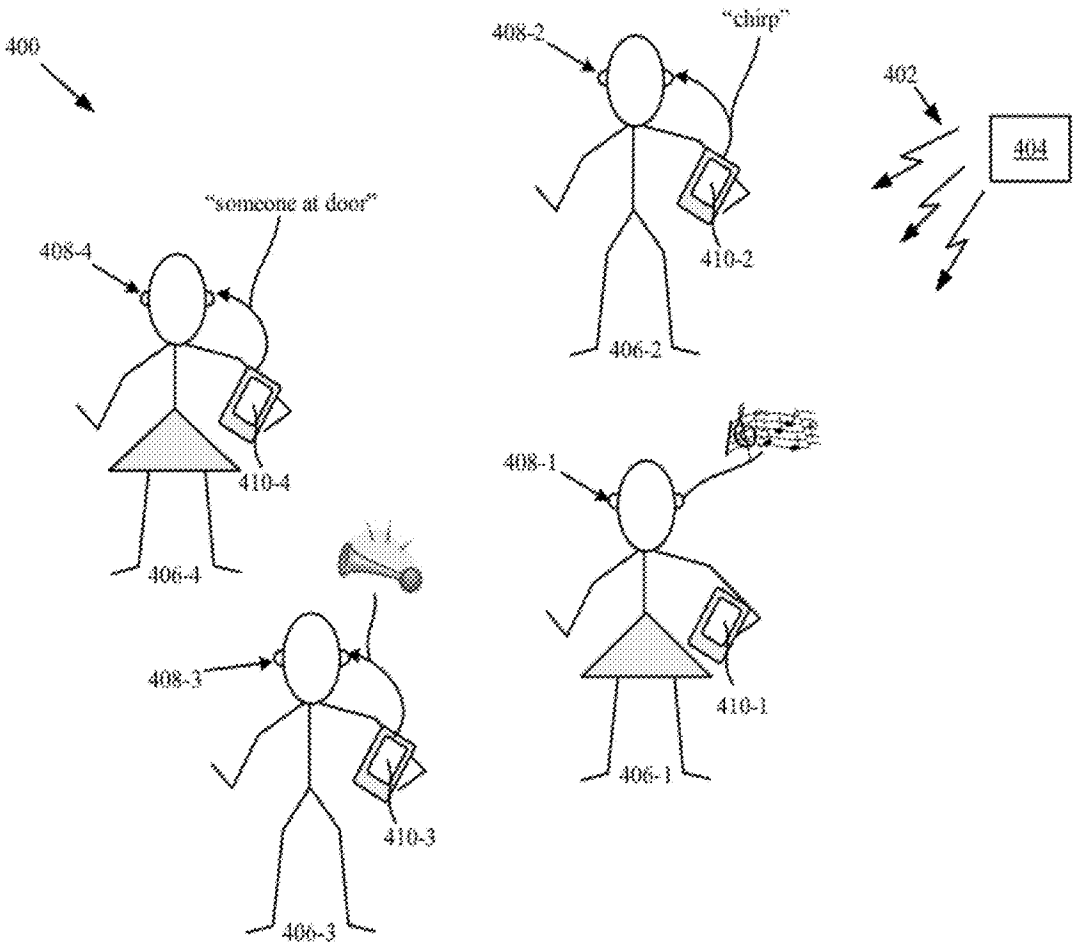
FIG. 4 shows an example of remapping in which each member of a group can perceive notification signal provided by a notifying device in a manner chosen by the member.

FIG. 4 shows an example of remapping in which each member of group 400 can perceive notification signal 402 provided by notifying device 404 in a manner chosen by the member. Presuming for this example only that notifying device 404 is a door bell that generates notification signal 402 indicating that someone is at the front door. In one embodiment, notification signal 402 can be audible in that notifying device 404 (i.e., doorbell) generates an audible sound along the lines of a buzzer, bell, klaxon, and so forth. In one embodiment, notification signal 402 can take the form of data such as a character string. In this case, notifying device 404 can itself be silent or can also provide an audible sound. In any case, notification signal 402 can be received by personal computing devices 410-1 through 410-4 in possession of members 406-1 through 406-4, respectively, of group 400. In some cases, however, a member (such as 406-1) can be in possession of hearing assistance device 408-1 having computing resources sufficient to handle all necessary processing of notification signal 402. In these cases, a member in possession of such a hearing assistance device does not require a personal computing device to process notification signal 402.

In any case, each of the members 406 of group 400 can choose to perceive notification signal 402 in any manner desired. For example, member 406-2 can choose to perceive notification signal 402 as a bird chirping (i.e., "chirp"), whereas member 406-1 can choose to perceive notification 402 as a show tune, member 406-4 as a voice intoning, "someone is at the door", and 406-3 as a horn honking. In order to perceive notification signal 402 in an individually selected manner, portable computing device 410 can be used to receive and process notification signal 402 (save for those situations as with member 406-1 in possession of hearing assistance device 408-1 that receives and processes notification signal 402 directly).

Once received, notification signal 402 can be processed in accordance with a particular enhancement module (s) 300. For example, portable computing device 410-2 can receive notification signal 402. Portable computing device 410-2 can then identify the source of notification signal 402. In one embodiment, the identification can be based upon location information or source identification included in or otherwise associated with notification signal 402. Once the source of notification signal 402 is identified, portable computing device 410-2 can retrieve an appropriate enhancement module(s) from storage device 148. In this particular case, the appropriate enhancement module can be one associated with a bird chirping, bird song, and so on. Portable computing device 410-2 can then process notification signal 402 in accordance with the retrieved enhancement module. The processed notification signal can then be passed directly to hearing assistance device 408-2 which then provides an output signal (audible sound, vibrations, electrical stimulus, etc.) perceivable to member 406-2. In one embodiment, personal computing device 408 can take the form of a smartphone such as an iPhone™ or personal media player such as an iPod™.

Figure 5:
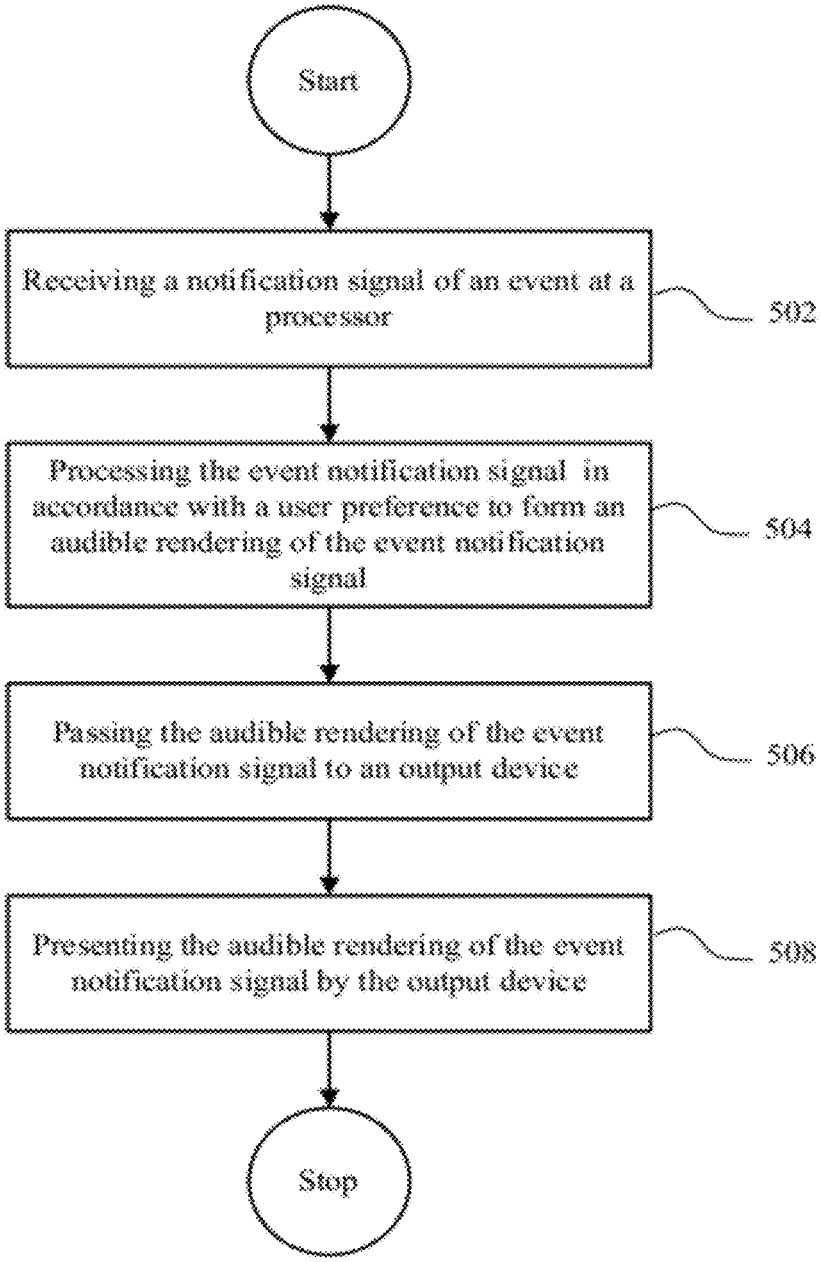
FIG. 5 is a flowchart detailing a process in accordance with the described embodiments.

FIG. 5 shows a flowchart detailing process 500 in accordance with the described embodiments. Process 500 can be carried out by a hearing assistance system. In one embodiment, the hearing assistance system can include a computing device in communication with a hearing assistance device. In one embodiment, the hearing assistance system can include only the hearing assistance device or only the computing device. In this way, all processing can be performed within either the hearing assistance device or the computing device. In any case, process 500 can be carried out by performing at least the following operations. At 502, an event notification signal generated by a notifying device in response to an external event is received at a processing device in communication with the hearing assistance device. In one embodiment, the hearing assistance device can take the form of a hearing aid that can, for example, be placed within an auditory channel of a hearing impaired individual. In one embodiment, the hearing assistance device can take the form of ear buds that while placed in proximity to the user's ear channel, they are typically not designed to be placed within the user auditory channel. In one embodiment the hearing assistance device can take the form of an over the ear device such as head phones.

The event notification signal can be associated with a first audible signal generated by a notifying device such as a doorbell, telephone, microwave oven timer and so on. At 504, the first audible signal is processed by the processing device to form an audible rendering corresponding to the event notification signal. In one embodiment, the processing of the event notification signal can be re-mapped from the first audible sound to a second audible sound based upon a remapping protocol. For example, activation of a doorbell mechanism (event) can be associated with a notification signal corresponding to a first audible sound of a bell ringing. However, in some cases, the notification signal can be remapped from the first audible sound to a second audible sound (e.g., bird chirping) that is then associated with the event. In this way, when the doorbell mechanism is activated, the user will perceive a sound of a bird chirping and not a bell ringing. In one embodiment, the processing of the event notification signal can be carried out in accordance with user specific parameters that can be used to improve aspects of the user's hearing impairment (such as age related high frequency hearing loss). The user specific parameters can be included in or otherwise associated with a hearing aid profile specific to the user.

At 506, the processed notification signal in the form of the first audible signal is passed to the hearing assistance device. In one embodiment, the first audible signal can be wirelessly passed to the hearing assistance device in real time. It should be noted that in those cases where the hearing assistance system includes the hearing assistance device that performs the processing, then clearly there is no need to pass the processed notification. In any case, at 508, the hearing assistance device outputs the first audible signal in such a way so as to be perceived by the user. In one embodiment, the first audible signal can be output in the form of electrical signals that can be used to stimulate auditory nerves. In other embodiments, the first audible signal can cause an output device in the form of an acoustic transducer to output audible sound energy.

Figure 6:
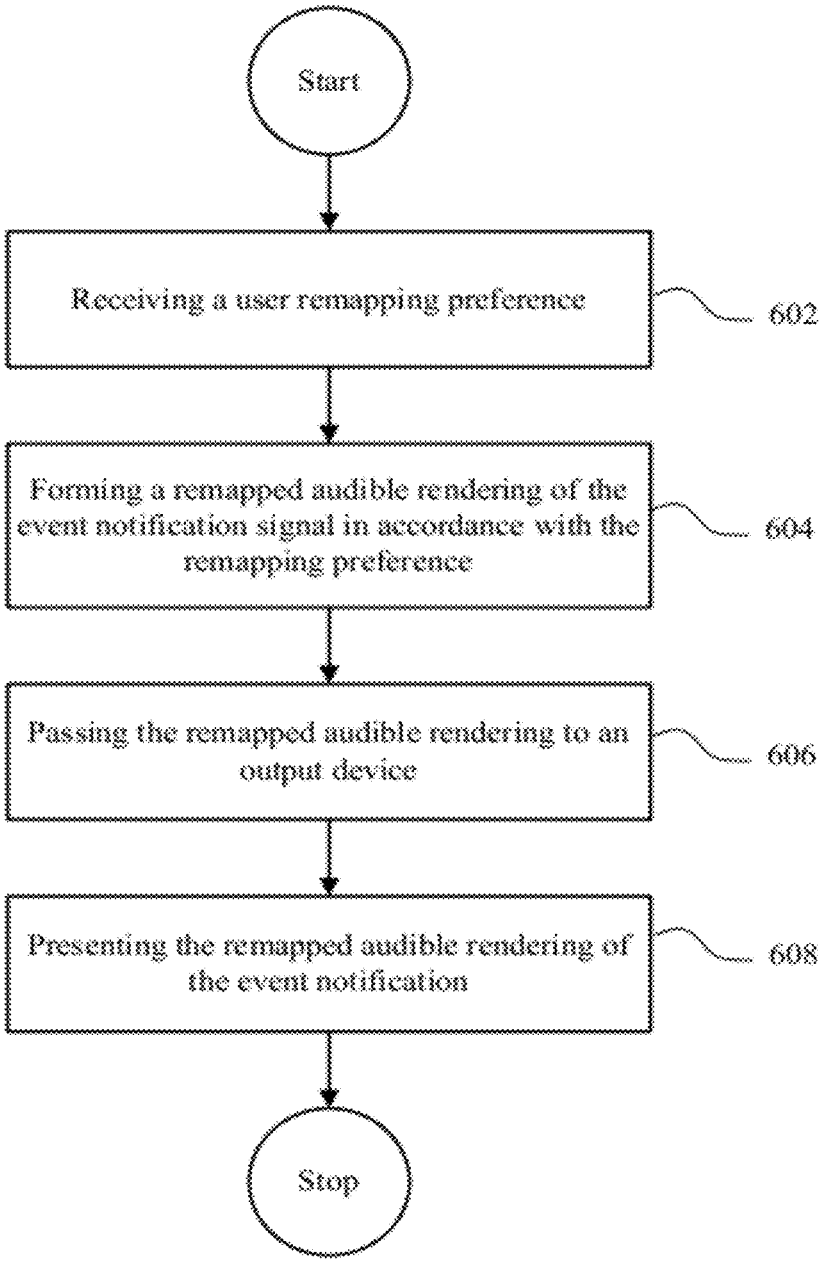
FIG. 6 is a flowchart detailing a process for remapping an audible rendering of an event notification signal in accordance with the described embodiments.

FIG. 6 shows a flowchart detailing process 600 for remapping the association between an event notification signal and a first audible rendering of the event notification signal in accordance with the described embodiments. Process 600 can begin at 602 by receiving a remapping preference. In one embodiment, the remapping preference can be obtained from a user preference file. For example, an event corresponding to activating a doorbell mechanism can be associated with an audible notification of a bell ringing. However, when remapped using the remapping preference, the event to be associated with a remapped audible notification corresponding to a bird chirping. At 604, the second audible rendering of the event notification is formed in accordance with the remapping preference. Again using the example of the doorbell, the sound of the bell ringing can be re-mapped to a text message, "someone is at the door". At 606, the second audible rendering is passed to an output device where the second audible rendering of the event notification signal is presented at 608.

Figure 7:
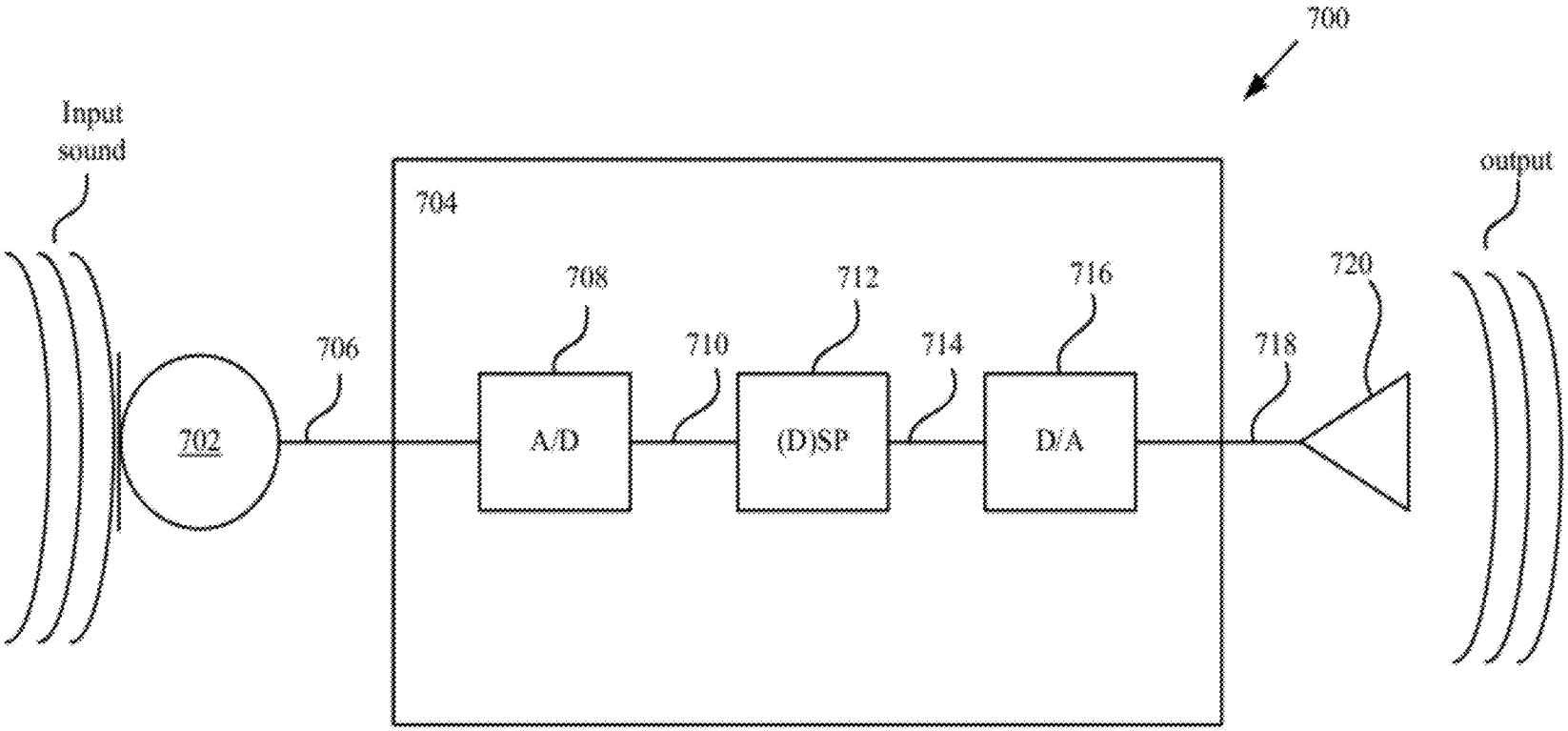
FIG. 7 is a block schematic showing another embodiment of a hearing assistance device in the form of a hearing aid.

FIG. 7 is a block schematic showing another embodiment of hearing aid 102 in the form of hearing aid 700. Hearing aid 700 can include at least audio sensor 702 arranged to detect acoustic energy that can take the form of sound. In one embodiment, audio sensor 702 can take the form of (one or more) microphone 702 connected to an input node of audio processing circuitry 704. Microphone 702 can use, for example, a vibrating membrane that can mechanically respond to sound waves impinging on its surface. The vibrating membrane can interact with a transducer (not shown) to create electrical signal 706 that is analogous (i.e., analog) to the detected sound waves.

Analog signal 706 can be passed to audio processing circuitry 704 for processing. It should be noted that audio processing circuitry 604 can be totally analog in nature, whereas in other embodiments, audio processing circuitry 704 can have some components that are analog while other components are digital. However for the remainder of this discussion and without loss of generality, audio processing circuitry 704 will be considered as being fully digital in nature. Therefore, digital audio processing circuitry 704 can include analog to digital (A/D) converter unit 708 arranged to receive analog signal 706 generated by microphone 702. A/D converter unit 708 converts analog signal 706 into digital signal 710 using any suitable digitization process. For example, A/D converter unit 708 can periodically sample analog signal 706, the sampled value of analog signal 706 being used to form digital signal 710.

In one embodiment, an output node of A/D converter unit 708 can be connected to (digital) signal processor 712. DSP 712 can include at least additional signal processing circuits (not shown) for filtering, compressing and amplifying input digital signal 710 to form output digital signal 714 at an output node of DSP 712 that can, in turn, be connected to an input node of a digital/analog (D/A) converter 716. D/A converter 716 can convert digital signal 714 into a corresponding analog signal 718 at an output node of D/A converter 716 that can be connected to and be used to drive output transducer 720. It should be noted, however, that in an alternative embodiment, DSP 612 can be configured in such a way to drive output transducer 720 directly without requiring D/A converter 716.

In one embodiment, DSP 712 can be programmable by which it is meant that the audio processing carried out by DSP 712 can be widely varied. For example, DSP 712 can be programmed according to a hearing aid profile that can include a plurality of settings each of which can alter a corresponding audio processing operation. For example, the settings can include various frequency response curves (along the lines of an equalizer), gain control, filtering such as notch or band pass filtering and the like. In this way, hearing aid 700 can adapt its signal processing to a wide number of variables such as the environmental (i.e., ambient) noise level, room acoustic characteristics, user provided changes to parameters and so on.

In one embodiment, a hearing aid profile can include a set of rules relating to speech intelligibility implemented in DSP 712 that can be used to optimize the signal processing by, for example, reducing or even merely characterizing ambient noise based on an analysis carried out by DSP 712. In one embodiment the signal processing can be used to improve overall signal reproduction to benefit intelligibility of speech in the reproduced audio signal. These rules are preferably based on the theory of the speech intelligibility index, but may be adapted to other beneficial parameters relating to audio reproduction in alternative embodiments.

Furthermore, in an alternative embodiment, parameters other than the individual frequency band gain values can be incorporated as output control parameters. These values can, for example, be attack or release times for gain adjustments, compression ratio, noise reduction parameters, microphone directivity, listening program, frequency shaping, and other parameters. Alternative embodiments that incorporate several of these parameters can easily be implemented, and the selection of which parameters will be affected by the analysis may be applied by the hearing aid provider at the time of fitting the hearing aid to the individual user, or subsequent to the fitting, using any number of techniques described herein.

Figure 8:
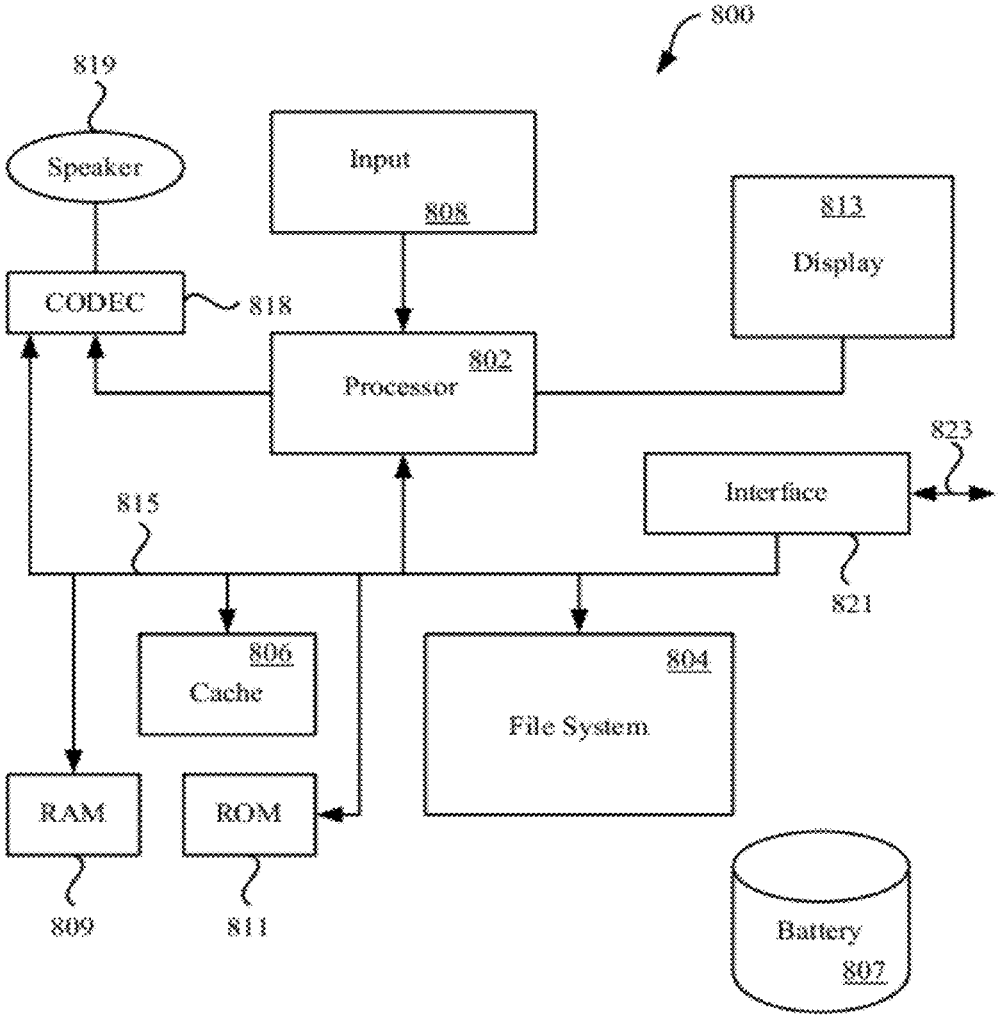
FIG. 8 is a representative computing system in accordance with the described embodiments.

FIG. 8 is a block diagram of an electronic device 800 suitable for use with the described embodiments. The electronic device 800 illustrates circuitry of a representative computing device. The electronic device 800 includes a processor 802 that pertains to a microprocessor or controller for controlling the overall operation of the electronic device 800. The electronic device 800 stores media data pertaining to media items in a file system 804 and a cache 806. The file system 804 is, typically, a storage disk or a plurality of disks. The file system 804 typically provides high capacity storage capability for the electronic device 800. However, since the access time to the file system 804 is relatively slow, the electronic device 800 can also include a cache 806. The cache 806 is, for example, Random-Access Memory (RAM) provided by semiconductor memory. The relative access time to the cache 806 is substantially shorter than for the file system 804. However, the cache 806 does not have the large storage capacity of the file system 804. Further, the file system 804, when active, consumes more power than does the cache 806. The power consumption is often a concern when the electronic device 800 is a portable media device that is powered by a battery 807. The electronic device 800 can also include a RAM 809 and a Read-Only Memory (ROM) 811. The ROM 811 can store programs, utilities or processes to be executed in a non-volatile manner. The RAM 809 provides volatile data storage, such as for the cache 806.

The electronic device 800 also includes a user input device 808 that allows a user of the electronic device 800 to interact with the electronic device 800. For example, the user input device 808 can take a variety of forms, such as a button, keypad, dial, touch screen, audio input interface, visual/image capture input interface, input in the form of sensor data, etc. Still further, the electronic device 800 includes a display 813 (screen display) that can be controlled by the processor 802 to display information to the user. A data bus 815 can facilitate data transfer between at least the file system 804, the cache 806, the processor 802, and the CODEC 817.

In one embodiment, the electronic device 800 serves to store a plurality of media items (e.g., songs, podcasts, etc.) in the file system 804. In one embodiment, file system 804 can include non-transitory computer readable medium for storing computer code executable by processor 802. When a user desires to have the electronic device play a particular media item, a list of available media items is displayed on the display 813. Then, using the user input device 808, a user can select one of the available media items. The processor 802, upon receiving a selection of a particular media item, supplies the media data (e.g., audio file) for the particular media item to a coder/decoder (CODEC) 817. The CODEC 817 then produces analog output signals for a speaker 819. The speaker 819 can be a speaker internal to the electronic device 800 or external to the electronic device 800. For example, headphones or earphones that connect to the electronic device 800 would be considered an external speaker.

The electronic device 800 also includes a network/bus interface 821 that couples to a data link 823. The data link 823 allows the electronic device 800 to couple to a host computer or to accessory devices. The accessory devices can include ear buds, head phones, a hearing aid and such. The data link 823 can be provided over a wired connection or a wireless connection. In the case of a wireless connection, the network/bus interface 821 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A method of presenting an audible rendering of an event notification signal generated by a notifying device in response to an external event, the method comprising:

receiving the event notification signal at a processing device in communication with an output device that is included in an accessory unit;

processing the event notification signal by the processing device in accordance with a user preference, comprising a user remapping preference, by generating a remapped audible rendering of the event notification signal in accordance with the user remapping preference, wherein the remapped audible rendering of the event notification signal is different from a non-remapped audible rendering of the event notification signal;

providing the remapped audible rendering of the event notification signal to the output device; and presenting the remapped audible rendering of the event notification signal by the output device.

2. The method as recited in claim 1, wherein the processing device is a portable computing device in communication with the accessory unit.

3. The method as recited in claim 2, wherein the portable computing device is arranged to establish a communication channel with the accessory unit; and wherein the providing comprises providing the remapped audible rendering of the event notification signal to the accessory unit via the communication channel.

4. The method as recited in claim 1, wherein the accessory unit is a hearing aid, and wherein the processing device is included within the hearing aid.

5. A system arranged for providing hearing assistance, comprising:

a processing device with one or more processors; and a hearing assistance device in communication with the processing device, wherein the hearing assistance device comprises an output device arranged to provide an output suitable for being audibly perceived by a user of the system;

wherein the one or more processors of the processing device are configured to:

receive an event notification signal provided by a notifying device indicating that an event has occurred;

process the event notification signal in accordance with an audio processing profile, comprising a user remapping preference, so as to generate a remapped audible rendering of the event notification signal in accordance with the user remapping preference, wherein the remapped audible rendering of the event notification signal is different from a non-remapped audible rendering of the event notification signal; and provide the remapped audible rendering of the event notification signal to the hearing assistance device; and wherein the output device of the hearing assistance device is configured to present the remapped audible rendering of the event notification signal.

6. The system as recited in claim 5, wherein the processing device is a portable communication device in communication with the hearing assistance device.

7. The system as recited in claim 5, wherein the hearing assistance device is a hearing aid and the audio processing profile is a hearing aid profile comprising at least one hearing aid parameter used to condition the remapped audible rendering.

8. The system of claim 6, wherein the portable communication device is configured to establish a communication channel with the hearing assistance device; and wherein the providing comprises providing the remapped audible rendering of the event notification signal to the hearing assistance device via the communication channel.

9. The system of claim 5, wherein the hearing assistance device is a hearing aid, and wherein the processing device is included within the hearing aid.

10. A non-transitory computer readable medium for storing computer code executable by one or more processors of a processing device in communication with a hearing assistance device, the computer readable medium comprising:

computer code for receiving an event notification signal from a notifying device at the processing device;

computer code for processing the event notification signal by the processing device in accordance with a user preference, comprising a user remapping preference, so as to generate a remapped audible rendering of the event notification signal in accordance with the user remapping preference, wherein the remapped audible rendering of the event notification signal is different from a non-remapped audible rendering of the event notification signal; and computer code for providing the remapped audible rendering of the event notification signal to the hearing assistance device.

11. The computer readable medium as recited in claim 10, wherein the hearing assistance device is a hearing aid.

12. The computer readable medium as recited in claim 11, wherein the processing device is included within the hearing aid.

13. The computer readable medium as recited in claim 10, wherein the processing device is a portable computing device in communication with the hearing assistance device.

14. The computer readable medium as recited in claim 13, further comprising, computer code for establishing a communication channel with the hearing assistance device; and wherein the computer code for the providing comprises computer code for providing the remapped audible rendering of the event notification signal to the hearing assistance device via the communication channel.

15. A hearing assistance device for presenting an audibilization of an event notification signal generated by a notifying device in response to at least one external event, the hearing assistance device comprising:

a processor;

a data storage device arranged to store at least a user preference, comprising a user remapping preference;

an output device; and an interface in communication with the processor for receiving the event notification signal from the notifying device;

wherein the processor is configured to:

process the event notification signal so as to generate a remapped audibilization of the event notification signal in accordance with the user remapping preference, wherein the remapped audibilization of the event notification signal is different from a non-remapped audibilization of the event notification signal;

provide the remapped audibilization of the event notification signal to the output device, and present the remapped audibilization of the event notification signal by the output device.

16. The hearing assistance device as recited in claim 15, wherein the hearing assistance device is a hearing aid.

* * * * *